United States Patent [19]

Pozzobon

[11] Patent Number: 4,719,710

[45] Date of Patent: Jan. 19, 1988

[54] OPERATING DEVICE FOR FOOT LOCKING ELEMENTS, PARTICULARLY FOR SKI BOOTS

[75] Inventor: Alessandro Pozzobon, Paderno Di Ponzano Veneto, Italy

[73] Assignee: Nordica S.p.A., Montebelluna, Italy

[21] Appl. No.: 897,564

[22] Filed: Aug. 18, 1986

[30] Foreign Application Priority Data

Sep. 4, 1985 [IT] Italy ..... 22896/85[U]

[51] Int. Cl.[4] ..... A43B 5/00; A43C 11/00

[52] U.S. Cl. ..... 36/119; 36/50; 24/68 B; 24/68 SK

[58] Field of Search ..... 36/117–121, 36/50; 24/68 B, 68 SK

[56] References Cited

U.S. PATENT DOCUMENTS

| | | | |
|---|---|---|---|
| 967,601 | 8/1910 | Bovard | 24/68 B |
| 4,575,958 | 3/1986 | Arieh et al. | 36/121 |
| 4,616,524 | 10/1986 | Bidoia | 36/120 X |
| 4,669,201 | 6/1987 | Pozzobon | 36/117 |
| 4,672,755 | 6/1987 | Benoit et al. | 36/117 |
| 4,677,768 | 7/1987 | Benoit et al. | 36/117 |

FOREIGN PATENT DOCUMENTS

| | | | |
|---|---|---|---|
| 0188818 | 7/1986 | European Pat. Off. | 36/119 |
| 2570257 | 3/1986 | France | 36/119 |
| 2572258 | 5/1986 | France | 36/119 |

*Primary Examiner*—James Kee Chi

*Attorney, Agent, or Firm*—Guido Modiano; Albert Josif

[57] ABSTRACT

This operating device comprises an operating knob rigid with a reel accommodating a cable winding thereon and acting on foot locking elements. The knob is supported on a lever pivoted at one end thereof to the ski boot so as to be movable between an opening position in which the knob is accessible from the outside and a closing position in which the knob is enclosed between the lever and the ski boot. The knob presents a half-moon-shaped lever pivoted to the knob and also movable between a rest position, flush with the knob, and an operating position, in which the half-moon-shaped lever is arranged transversally to the knob and acts as a gripping member therefor.

7 Claims, 5 Drawing Figures

35
4
33
40
32
31
3

12
20
22
21
11
1
35
10
13
30
5
22
50

10
2
3
22
1
21

OPERATING DEVICE FOR FOOT LOCKING ELEMENTS, PARTICULARLY FOR SKI BOOTS

BACKGROUND OF THE INVENTION

The present invention relates to an operating device for foot locking elements, particularly for ski boots.

As is known, in ski boots locking elements are currently employed, which are provided inside the shell, and act on the foot operating, as an example, a foot instep presser, a heel retention element, etc...

Said locking elements are operated by means of a small cable which is tightened, generally, by acting on a knob or similar element, which is positioned in the rear part of the ski boot.

With prior solutions, the currently employed operating elements, in order to allow for the exertion of a small effort, are generally remarkably bulky and furthermore they are positioned in sight on the rear part of the ski boot.

This fact, as well as causing aesthetical problems, has the disadvantage of leaving the operating element in an exposed position so that it may be subjected to blows or similar which could cause damage or accidental operation thereof.

SUMMARY OF THE INVENTION

The aim of the invention is indeed that of eliminating the above disadvantages by providing an operating device for foot locking elements in ski boots, which allows the possibility of not being in sight during skiing, thus offering the advantage of adequately protecting the device itself as well as improving the overall aesthetics of the boot.

Within the scope of the above described aim, a particular object of the invention is to provide an operating device having remarkably reduced dimensions, though allowing an easy grip, thus giving the possibility of exerting, without excessive efforts, the required tension on the small cable.

Still another object of the invention is to provide a device which can be easily and simply operated, since though it is positioned in the rear part of the boot, it is possible to arrange it in a position more easily accessible at the moment of its employment.

Not last object of the present invention is to provide a device which can be made out of a reduced number of component elements and that furthermore is advantageous from a merely economical point of view.

The above described aim, as well as the object described and others which will be made apparent hereinafter, are achieved by an operating device for foot locking elements, particularly for ski boots, according to the invention, comprising an operating knob for a winding reel of a cable unwinding along a locking element of the foot inside a ski boot, characterized in that it comprises a lever pivotably coupled on the ski boot and pivotably supporting on a face of the same said knob, said lever being locatable in an opening position, in which said knob is accessible from the outside, and in locking position in which said knob is enclosed between said lever and said boot.

BRIEF DESCRIPTION OF THE DRAWINGS

Further advantages and characteristics will be better apparent from the detailed description of an operating device for foot locking elements, particularly for ski boots, illustrated by way of example only in the accompanying drawings, where.

DESCRIPTION OF THE PREFERRED EMBODIMENTS

Figures 1, 4, 5:
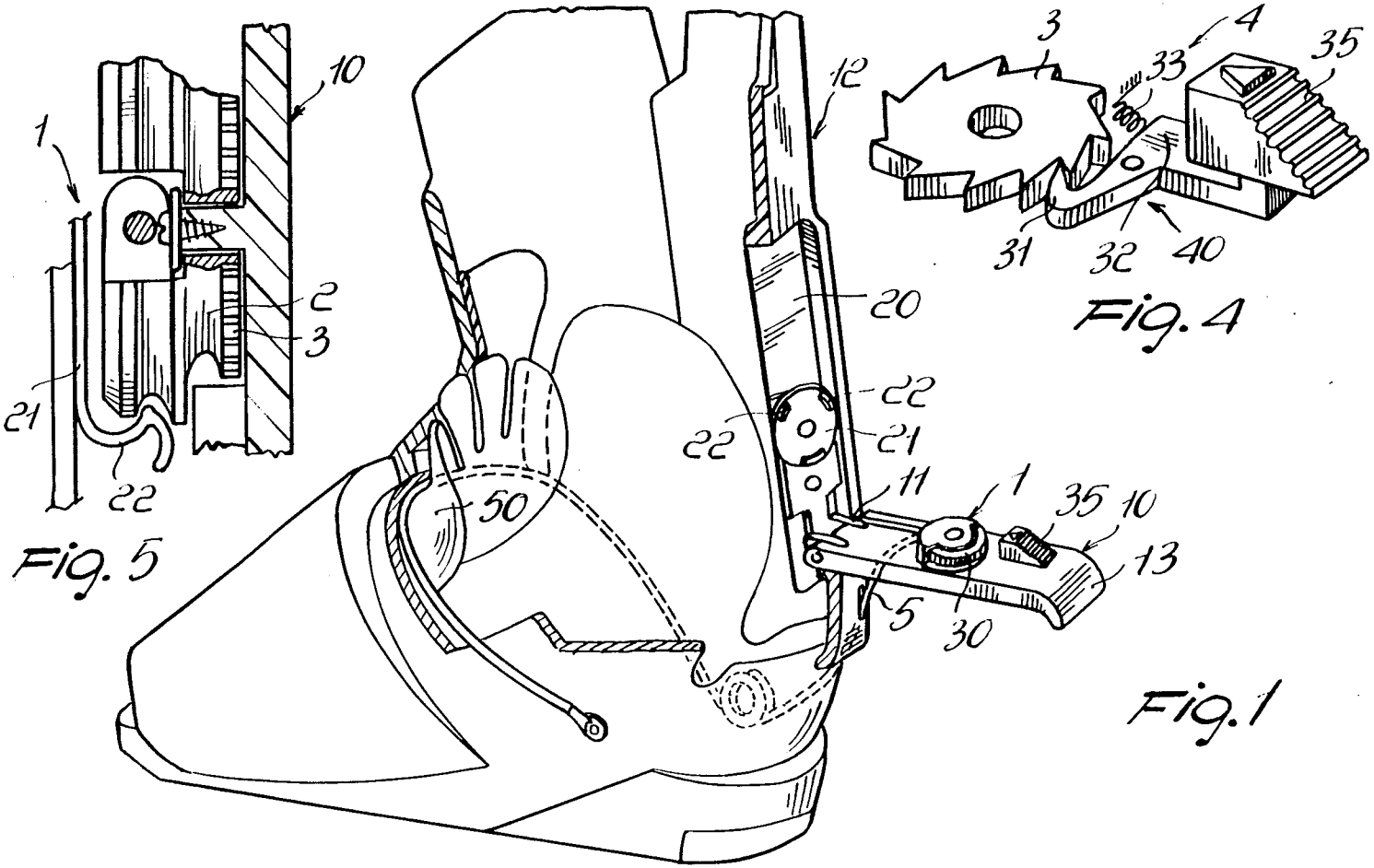
FIG. 1 is a schematic perspective view of a ski boot with the operating device, according to the invention.
FIG. 4 is a schematic perspective view of the means for preventing the rotation of the reel in an unwinding direction of the cable.
FIG. 5 illustrates the retention means of the lever in closed position.

With reference to the above drawings, the operating device for foot locking elements, particularly for ski boots, comprises a knob, indicated generally with the reference numeral 1, to which a reel 2 is rigidly coupled so as to rotate therewith. As usual, the reel 2 has a notched wheel 3 engaged by a ratchet gear, generally indicated with the reference numeral 4, which will be subsequently described, for selectively preventing the rotation of the reel 2 in the unwinding direction of a cable 5.

The knob 1 is pivotably supported on the inner side of a lever 10 which at one end thereof, preferably at the lower end 11, is pivotably coupled to the ski boot, indicated generally with the reference numeral 12.

The lever 10, which is preferably arranged in the rear part of the ski boot, at the end opposite to the pivot point, presents a grip appendix indicated at 13.

The lever 10 is advantageously located at a recess 20 defined by the rear part of the boot, the recess 20 being intended for accommodation of the knob 1, when the lever is arranged substantially flush to the boot.

On the bottom of the recess 20 is fixed a small plate 21, having peripheral elastic fins 22 capable of elastically engaging with a circumferential neck 23 defined on the knob 1, in such a way as to elastically retain the lever 10 in closed position.

Figures 2, 3:
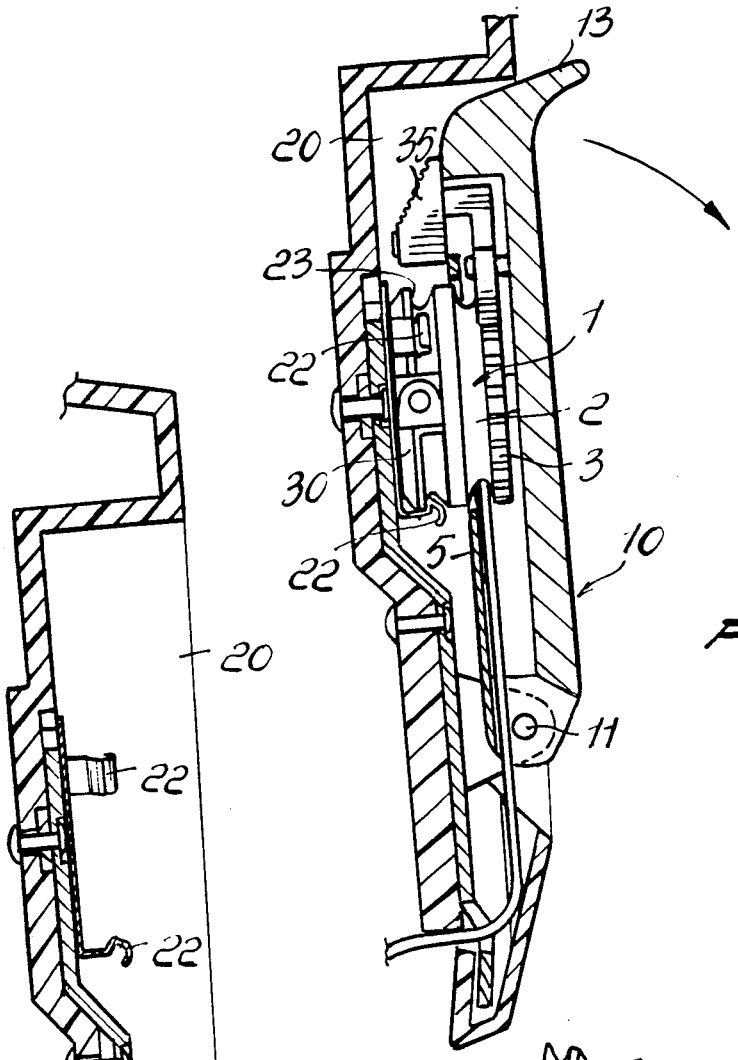
FIG. 2 is a cross-section of the operating device with the lever in closed position.
FIG. 3 is the operating device with the lever in open position.

The knob 1 presents a half-moon-shaped lever section 30 which is pivotably coupled along its diameter to the knob 1, thereby it can be swung out, as schematically indicated in FIG. 3, and defines a grip element, easily operated in order to rotate the knob in the cable winding direction so as to put it under tension.

The elastic fins 22 perform a twofold function; of elastically retaining the lever 10 in closing position, and of to automatically causing the upturning of the half-moon lever section 30 upon the opening of the lever 10. Indeed the fins 22, by engaging with the annular neck 23, bring about, when the lever 10 is opened, an upturning action of the half-moon lever section 30 due to the mutual engagement.

The fins 22 are preferably three uniformly distributed circumferentially in such a way that, whatever position the knob 1 assumes, at least one of the elastic fins 22 engages with the portion of the annular neck 23 which is formed in the half-moon-shaped lever section 30 and substantially extends for a semi-circumferential length.

As previously mentioned, the notched wheel 3 is prevented from rotating in the cable unwinding direction by ratchet gear means 4 comprising an oscillating hook 40, pivoted to the lever 10 and having a hook-like section 31, engageable with the teeth of the notched wheel 3, and an engagement appendix 32, on the side opposite to the hook-like section 31, on which a pusher spring 33 acts, for elastically keeping the hook 31 in engagement with the notches of the notched wheel 3.

The appendix 32 may be actuated by a button-like element 35 acting thereon and being slideably positioned on the inner side of the lever 10. Thereby the button-like element 35 may be operated by the user in order to overcome the elastic opposition of the pusher spring 33 with consequent oscillation of the hook 40 and disengagement of the hook-like section 31 from the notched wheel 3.

In practical use, with the lever 10 in open position, as is schematically illustrated in FIG. 1, the user, by means of the half-moon-shape lever section 30, can tighten the cable 5 which extends, in a per se known manner, e.g. above the presser 50 of the foot instep.

Once the desired tightening is performed, the knob is locked due to the engagement of the notched wheel 3 which is rigidly associated with the reel 2, which in turn is rigidly coupled to the knob 1.

Once the desired adjustment has been thus performed, the user can close the lever 10, with consequent arrangement of the knob 1 in the recess 20 defined in the rear part of the boot.

The lever 10 is held in closing position by the elastic engagement between the fins 22 and the annular neck 23 circumferentially defined on the knob.

For opening the locking elements it is sufficient to swing the lever 10 outwardly, overcoming the elastic resistance of the fins and simultaneously obtaining the opening of the half-moon-shaped lever section 30 engaging with the elastic fins as previously described.

On the contrary, in order to loosen the cable 5 and to unlock the operating device it is sufficient to act upon the button 35 in such a manner as to disengage the hook-like section 31 from the notches 3.

It should be noted that with the configuration described, every time the lever is upwardly rotated, the half-moon-shaped lever section 30 is automatically opened, so that the user already finds it in position for use.

Therefore, according to the invention, an operating device is provided that, during the employment of the ski boot, practically disappears inside the boot, being enclosed between the lever 10 and the boot itself.

Furthermore, the operating knob can be manufactured with reduced dimensions, as it can be easily operated by making use of the half-moon-shaped lever section which is pivoted along the diameter of the knob itself and automatically upturns, as explained, so as to show a protruding section which can be easily gripped.

Practically the materials employed, as long as compatible with the specific use, as well as the dimensions and the contingent shapes, may be any according to the requirements.

I claim:

1. Operating device for foot locking elements, particularly for ski boots, comprising an operating knob actuating a reel for winding thereon a cable acting on at least one foot locking element, a lever pivoted on the ski boot and rotatably supporting on a side thereof said knob, said lever being positionable in an opening position in which said knob is accessible from the outside and in a closing position in which said knob is enclosed between said lever and said ski boot.

2. An operating device, according to claim 1, wherein said knob presents a small half-moon-shaped lever section, pivotably connected with said knob, and movable from a first position, in which said half-moon-shaped lever section is flush with and contained within said knob, to a second operating position, in which said half-moon-shaped lever section is arranged substantially transverse to said knob.

3. An operating device, according to claim 1, wherein said lever is pivoted to said ski boot at a recess defined in said ski boot, said recess accommodating said knob with said lever in closing position.

4. An operating device, according to claim 2, wherein said lever is pivoted to said ski boot at a recess defined in said ski boot, said recess accommodating a small plate having circumferential elastic fins, said knob and said half-moon-shaped lever section defining an annular neck elastically engageable by said elastic fins with said lever section in said first position.

5. An operating device, according to claim 4, wherein said elastic fins are three uniformly distributed circumferentially on said small plate, and said half-moon-shaped lever section extends for a substantially semi-circumferential portion of said knob, thereby at least one of said elastic fins engages with said half-moon-shaped lever section, with said lever section in said first position.

6. An operating device, according to claim 1, further comprising means for removable locking the rotation of said reel in a cable unwinding direction, including a hook element pivoted on said lever, said hook element defining a hook-like section engageable with a notched wheel rigidly associated to said reel and an appendix biased by a pusher spring for elastically keeping said hook-like section in engagement with said notched wheel, with said appendix engaging a button-like element for disengaging said hook-like section from said notched wheel, overcoming the elastic resistance of said pusher spring.

7. An operating device, according to claim 1, wherein said knob has a small half-moon-shaped lever section pivotally connected thereto and having an annular neck, said lever section being movable from a first position, in which said lever section is flush with said knob, to a second position, in which said lever section is arranged trasversely to said knob, and said operating device further comprises a small plate connected to said ski boot in a position facing said knob in said closing position of said lever, said small plate having circumferential elastic fins, at least one of said elastic fins being arranged in such a position to thereby engage with said annular neck of said lever section and to bring said lever section in said second position when said lever is opened from said closing to said opening position.

* * * * *